United States Patent [19]

Hedegaard et al.

[11] 3,962,980

[45] June 15, 1976

[54] THREAD CUTTER FOR SEWING MACHINES

[75] Inventors: Arne Marius Hedegaard, Hvidovre; Hugo Sand Jensen, Copenhagen, both of Denmark

[73] Assignee: Rothenborg Patent & Licens K/S, Copenhagen, Denmark

[22] Filed: Feb. 18, 1975

[21] Appl. No.: 550,225

[30] Foreign Application Priority Data

Mar. 18, 1974 Germany ..... 2412989

[52] U.S. Cl. ..... 112/252; 112/DIG. 1

[51] Int. Cl.[2] ..... D05B 65/02; D05B 65/06

[58] Field of Search ..... 112/252, DIG. 1

[56] References Cited

UNITED STATES PATENTS

| | | | |
|---|---|---|---|
| 2,426,026 | 8/1947 | Kehrer | 112/252 |
| 2,712,805 | 7/1955 | Peterson et al. | 112/252 |
| 3,058,438 | 10/1962 | Russell et al. | 112/DIG. 1 |
| 3,779,189 | 12/1973 | Fox | 112/252 |
| 3,922,983 | 12/1975 | Schips et al. | 112/252 |

*Primary Examiner*—Werner H. Schroeder
*Assistant Examiner*—Conrad L. Berman
*Attorney, Agent, or Firm*—William R. Liberman

[57] ABSTRACT

A suction tube is disposed closely adjacent a continuously operating chain thread cutting mechanism at right angles to the normal movement of the thread chain, the assembly being removably mounted on the free end of the arm of a sewing machine of the feed-off-the-arm or flatlock type.

5 Claims, 3 Drawing Figures

THREAD CUTTER FOR SEWING MACHINES

The present invention relates generally to a thread chain cutter for sewing machines including a suction tube arranged for cooperation with a continuously working cutting device.

Thread chain cutters of various types are known mounted on the throat plate of a sewing machine wherein the suction tube is arranged in coplanar relationship to the throat plate, away from the presser foot; that is, parallel to the direction of movement of the sewn material as it leaves the presser foot, the mouth of which suction tube is provided with a blade oscillating in a horizontal plane which, in cooperation with a stationary blade, severs the threads drawn into the suction tube. In such embodiments the threads will normally be drawn into the suction tube in a direction substantially parallel to the reciprocating plane of the blade, as a result of which positive cutting of the threads is always achieved. Further, these devices, as additions to the machinery, are not ordinarily suitable for use in connection with the "feed-off-the-arm" or flatlock machines.

It is the main object of the present invention, therefore, to provide a thread cutter of the kind referred to but which can be used with a "feed-off-the-arm" or flatlock machine, and by the use of which a positive severing of the threads is accomplished at the beginning as well as at the end of the thread chain. To attain this object, the present invention provides a thread chain cutter wherein the suction tube is comprised of a vertically extending bore, the axis of which is substantially perpendicular to the supporting surface of the material being stitched, and mounted in a housing supported on the outer end of the arm of the sewing machine so that the outline of said housing corresponds to the outline of said arm, and the outer wall of the suction tube is provided with a thread chain-receiving notch which is traversed by an oscillating blade, thereby to provide a positive cutting arrangement. By the attachment of our invention, a thread cutter is provided which is of a very simple construction and which, when mounted on the end of the arm of a "feed-off-the-arm" sewing machine, will not interfere with the movement of the material. Further, the thread chain ends to be severed are first drawn into the suction tube and then, after the seam has passed the mouth of the tube, the chain is drawn through the notch and thence into the working region of the blade in an elongated condition produced by the suction, in a direction substantially perpendicular to the oscillating plane of the blade, thereby to ensure a positive and reliable severing of the thread ends. By cutting off the threads at the trailing end of the seam, the thread chain is initially moved past the suction tube, and pulled down into the cutter by its own weight or by the operator.

Preferably, the cutting mechanism consists of a notched stationary blade, one side of which defines the edge against which the leading edge of the movable blade shears the thread chain. This stationary blade defines a partial closure or cover fixed to the housing containing the reciprocating blade and the suction tube.

When seaming delicate fabrics, as used in ladies' underwear on a flatlock machine, it must be borne in mind that the light material also may be drawn into the suction tube and thereby damaged by the reciprocating cutting blade. According to our invention, this possibility is eliminated by providing a roller with suitable finish over the mouth of the tube. The roller is driven so as to engage the material being sewn thereby to aid the forward movement of the material away from the blade area.

The movement of the reciprocating blade will be controlled by conventionally available means (not shown) from and by the moving parts in the arm of the sewing machine.

A preferred form of the thread cutter according to the present invention will be described hereinbelow in detail by reference to the accompanying drawings, in which.

Figure 1:
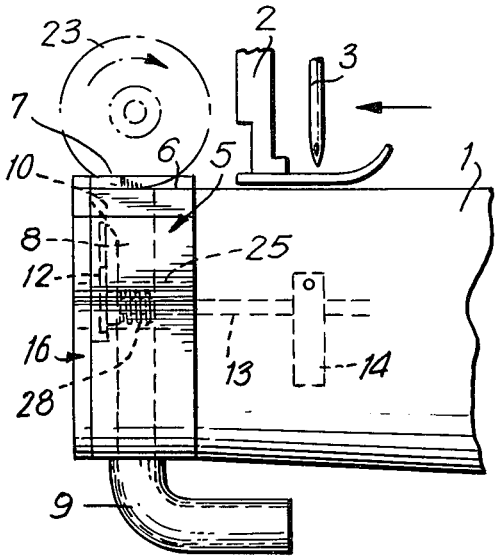
FIG. 1 is a generally schematic side view of the thread cutter mounted on the end of the arm of a "feed-off-the-arm" sewing machine.

Referring to the drawings, reference numeral 1 indicates the outer end of the arm of a "feed-off-the-arm" type of sewing machine the upper surface of which is covered by a conventional throat plate (not shown) below and vertically in line with presser foot 2 and the vertically reciprocating needle 3. Arrow 4 indicates the direction of movement of the work being sewn. The thread cutter housing containing the elements of the present invention, indicated generally by reference numeral 5, is mounted at the outer extremity of arm 1, by means of suitable threaded bolts as will be detailed below. Housing 5 includes a cast or milled body member 5' from a suitable hard metal block, as steel, is provided with a flat upper face 6 having a narrow shelf 7 extended upwardly from one side thereof to serve as a guide for the control of movement of the work. A recess 11 is formed in the leading or front wall 20 of cutter block 5, the recess being spaced inwardly of the sides and lower edge of face 20. A vertical bore 8, defining a suction tube, extends downwardly through block 5 from the junction of upper face 6 and frontal recess 11, as indicated at 10, and has connected to its lower end a suitable pipe or tube 9 communicating with the source of negative pressure (not shown). A tapped opening 25 extends transversely from front face to rear thereof through block 5 from the lower portion of recess 11, opening 25 aligning with an opening 26 upwardly offset from the lower end 27 of cutter blade 12. Opening 25 is keyed onto the end of a rocking shaft 13 so that blade 12 can be swung back and forth within recess 11 and across U-shaped notch 17 in the face plate 16 which closes off the leading wall 20 of block 5.

A shaft 13 control lever 14 is provided to actuate cutter 12 from within arm 1 of the sewing machine, the connection being conventional, as is the actuation of the control lever.

Face plate 16 is shaped to coincide with leading wall 20 of block 5, and is provided with peripheral transverse bores 22 to register with transverse tapped bores 22' in block 5, for securement of face plate 16 over block 5 in airtight relationship. Bores 21 extend transversely through block 5, registering with tappings in the leading end of arm 1. Suitable screw bolts secure block 5 onto the free end of arm 1, as shown in FIG. 1.

Figure 2:
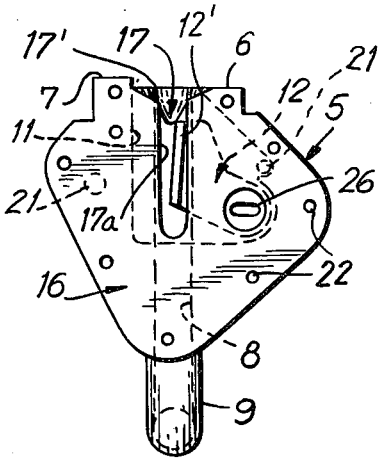
FIG. 2 is a front elevational view of the same.
Figure 3:
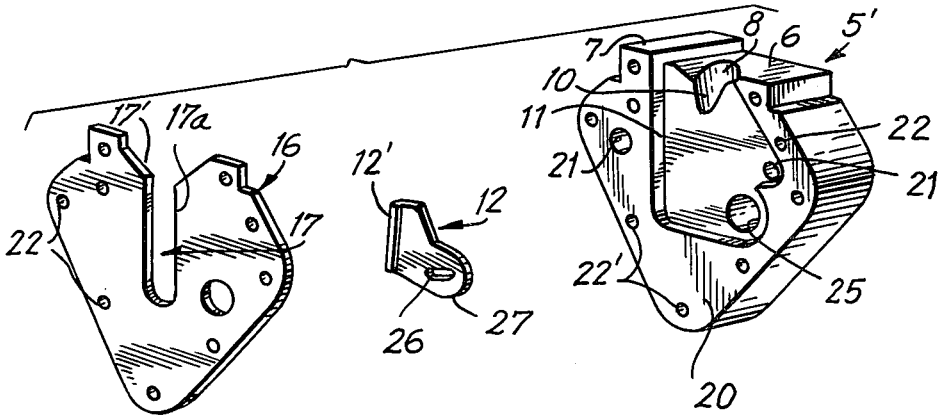
FIG. 3 is an exploded view of the basic components of the device.

Blade 12 is provided with a forward cutting edge 12' which at rest as seen in FIG. 2, lies along the inner edge of **17*a* of a U-shaped notch 17 extending downwardly into and from the top of face plate 16, the slot having a wide U-shaped mouth 17' leading into the narrow slot. The sides of slot 17 constitute stationary blades cooperating with movable blade edge 12'** to perform the cutting or shearing operation.

Cutter blade 12 is biased by compression coil spring 28 against the rear of face plate 16, thus, as cutter 12 is reciprocated across notch 17 it will shear across the thread drawn thereinto by the suction developed at the upper end 10 of vertical bore 8.

By the apparatus of the present invention there is provided for the first time a thread cutter which can be mounted on a "feed-off-the-arm" or flatlock sewing machine and which ensures that the thread ends to be severed are brought into the working region of the cutter blade in an extended condition and substantially perpendicular to the plane of movement of the cutter blade, so that a positive and reliable severing will always be obtained. The severed sewing threads will be drawn down the suction tube to a suitable depository for subsequent disposition.

The cutter block 5 and face plate 16 are shaped as desired to register smoothly with the outline of the machine arm 1 onto which the attachment of the present invention is mounted. Also, when seaming or sewing light or delicate fabrics, it is highly desirable that the fabrics be moved as a positive proposition past and away from the cutter blade, and a horizontally pivoted driven roller 23 is mounted above and in line with bore 8. The surface of roller 23 is formed or so treated as to maintain driving contact with the material being sewn.

We claim:

1. The combination of a cutter attachment for a sewing machine having a free end arm, the attachment comprising a block having a flat upper face and a recessed front face, the block being removably mounted on the free end of the arm, the block having a vertical bore therethrough terminating at its upper end at the junction of the recessed front face of the block and the upper face thereof, the axis of the bore being normal to the plane of the block upper face, a source of negative pressure associated with the machine and connected to the bore through the block at the lower end thereof, a cutter blade mounted on the block within the block recess, a face plate mounted over the recess in air-tight relationship to the vertical bore, a notch in the face plate extending downwardly from the upper edge thereof, the notch communicating with the upper end of the bore, the cutter blade reciprocating across the notch thereby to sever stitch chains suction-drawn down the bore and the face plate notch.

2. The combination of claim 1, wherein the notch in the face plate is U-shaped.

3. The combination of claim 1, wherein the cutter blade is mounted on a horizontal pivot and the cutting edge thereof reciprocates in a vertical plane across the notch in the face plate.

4. The combination of claim 1, wherein the thickness of the cutter blade is substantially equal to the depth of the recess in which it reciprocates.

5. The combination of claim 1 including a roller mounted on a horizontal pivot above and in line with the suction bore, rotation of the roller driving the work being sewn past the suction tube and away from the cutter blade.

* * * * *